US006270325B1

(12) United States Patent
Hsieh

(10) Patent No.: US 6,270,325 B1
(45) Date of Patent: Aug. 7, 2001

(54) MAGNETICALLY ASSEMBLED COOLING FAN

(76) Inventor: Hsin-Mao Hsieh, No. 6, East Section, Chiao Nan Li, Industrial 6th Rd., Pingtung City, Pingtung Hsien (TW)

( * ) Notice: Subject to any disclaimer, the term of this patent is extended or adjusted under 35 U.S.C. 154(b) by 0 days.

(21) Appl. No.: 09/395,588

(22) Filed: Sep. 14, 1999

(51) Int. Cl.[7] ..... F04B 17/00
(52) U.S. Cl. ..... 417/423.12; 417/423.7
(58) Field of Search ..... 417/423.12, 423.13, 417/423.14, 316, 420, 423.15

(56) References Cited

U.S. PATENT DOCUMENTS 4,203,048 * 5/1980 Sato ..... 310/268
4,553,075 * 11/1985 Brown et al. ..... 318/254
4,987,331 * 1/1991 Horng ..... 310/254
5,019,735 * 5/1991 Lee ..... 310/89
5,288,216 * 2/1994 Bolte ..... 417/423.7
5,492,458 * 2/1996 Horng ..... 417/423.7

* cited by examiner

*Primary Examiner*—Timothy S. Thorpe
*Assistant Examiner*—William Rodriguez
(74) *Attorney, Agent, or Firm*—William E. Pelton, Esq.

(57) ABSTRACT

A magnetically assembled cooling fan is disclosed. The cooling fan has an annular permanent magnet received therein and a metal plate with a pair of diagonally formed winged sections. The pair of diagonally formed winged sections are able to attract the fan assembly downward with respect to the housing, such that the problem caused by frictional resistance is overcome. Furthermore, a thrust bearing is provided at the free end of the shaft of the fan assembly so as to enable the shaft to rotate smoothly.

4 Claims, 6 Drawing Sheets

MAGNETICALLY ASSEMBLED COOLING FAN

BACKGROUND OF THE INVENTION

1. Field of the Invention

The present invention relates to a cooling fan, and more particularly to a magnetically assembled cooling fan. The cooling fan has a thrust bearing provided on the bottom of a shaft, such that there is no limitation to the types of the bearings provided around the shaft. Furthermore, the cooling fan has an elongated metal plate provided below the permanent magnet that is installed in the fan assembly, such that the assembly of the fan assembly is achieved by the attraction between the metal plate and the permanent magnet.

2. Description of Related Art

With reference to FIG. 5, the conventional brushless cooling fan has a fan assembly (70), a stator assembly (60), a circuit board (65) and a housing (50) for receiving the fan assembly (70), the stator assembly (60) and the circuit board (65). The stator assembly (60) has a first conjugated plate (62), a second conjugated plate (63), a coil (64) securely received between the first and the second conjugated plates (62, 63) and a sleeve (61) with which the first and second conjugated plates (62, 63) and the coil (64) are securely mounted on the bottom face (51) of the housing (50). The fan assembly (70) has a seat (71), a shaft (73) firmly mounted on the seat (71) and an annular permanent magnet (75) securely installed inside the fan assembly (70). Since the principle of operation of this type of brushless cooling fan is well known in the art, a detailed description is omitted. With reference to FIG. 6, during assembly, the shaft (73) is inserted through the first conjugated plate (62), the coil (64), the ball bearing (611), the pad (612) and the self-lubricating bearing (613) within the sleeve (61), the second conjugated plate (63) and the circuit board (65) into the housing (50). The portion of the shaft (73) extending into the housing (50) is then clamped by a fastener (731). Therefore, the rotation of the shaft (73) is affected by the tightness of the fastener (731) to the shaft (73). If the fastener (731) clamps the shaft (73) so tight that the rotation of the shaft (73) is difficult, the heat dissipation efficiency of the cooling fan is low. If the fastener (751) is not tight enough, the fan assembly (70) will move up and down within the housing (50) during operation. Furthermore, the design as previously described limits the first type of bearing chosen within the sleeve (61) to a ball bearing (611), then the self-lubricating bearing (613). The price for a ball bearing (611) is several times larger than that of a self-lubricating bearing (613). Thus, if there is no limitation to the type of the bearing, the cost for manufacturing the cooling fan will surely be greatly reduced.

To overcome the shortcomings, the present invention tends to provide an improved cooling fan assembly to mitigate and obviate the aforementioned problems.

SUMMARY OF THE INVENTION

The main objective of the invention is to provide an improved cooling fan assembly with a metal plate installed under the permanent magnet of the fan assembly to hold the fan assembly in place, such that there is no need for a fastener to hold the fan assembly in the housing.

Another objective of the invention is to provide a thrust bearing on the bottom of the housing. The thrust bearing abuts the free end of the shaft, such that there is no limitation to the type of bearing used in the sleeve.

Still another objective of the invention is to provide at least one retainer on the housing, such that even when the cooling fan is mounted upside down, the fan assembly will be held in place without falling out of the fan assembly.

Other objects, advantages and novel features of the invention will become more apparent from the following detailed description when taken in conjunction with the accompanying drawings.

DETAILED DEFSCRTPTION OF PREFERRED EMBODIMENT

Figure 1:
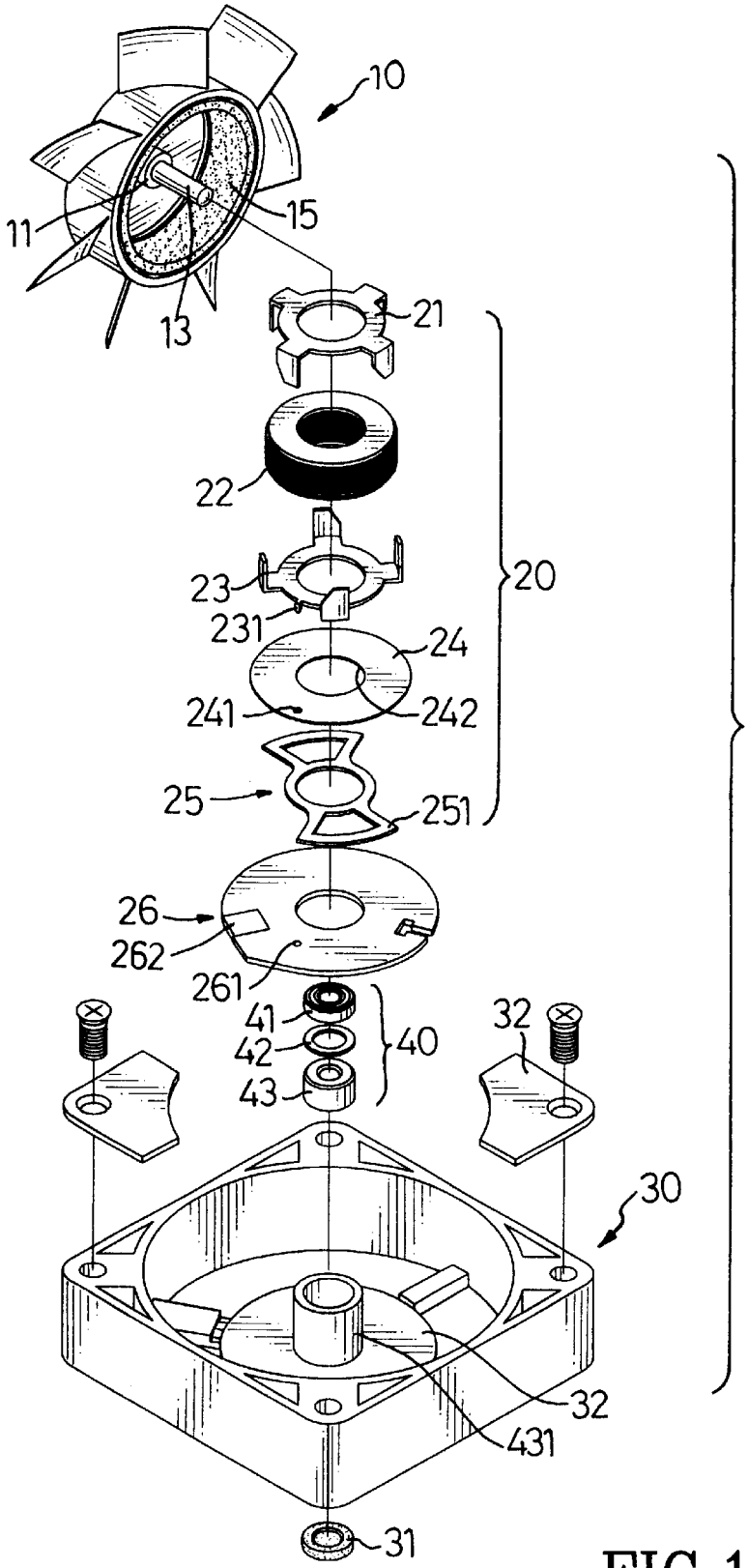
FIG. 1 is an exploded perspective view of the brushless cooling fan in accordance with the present invention.
Figure 5:
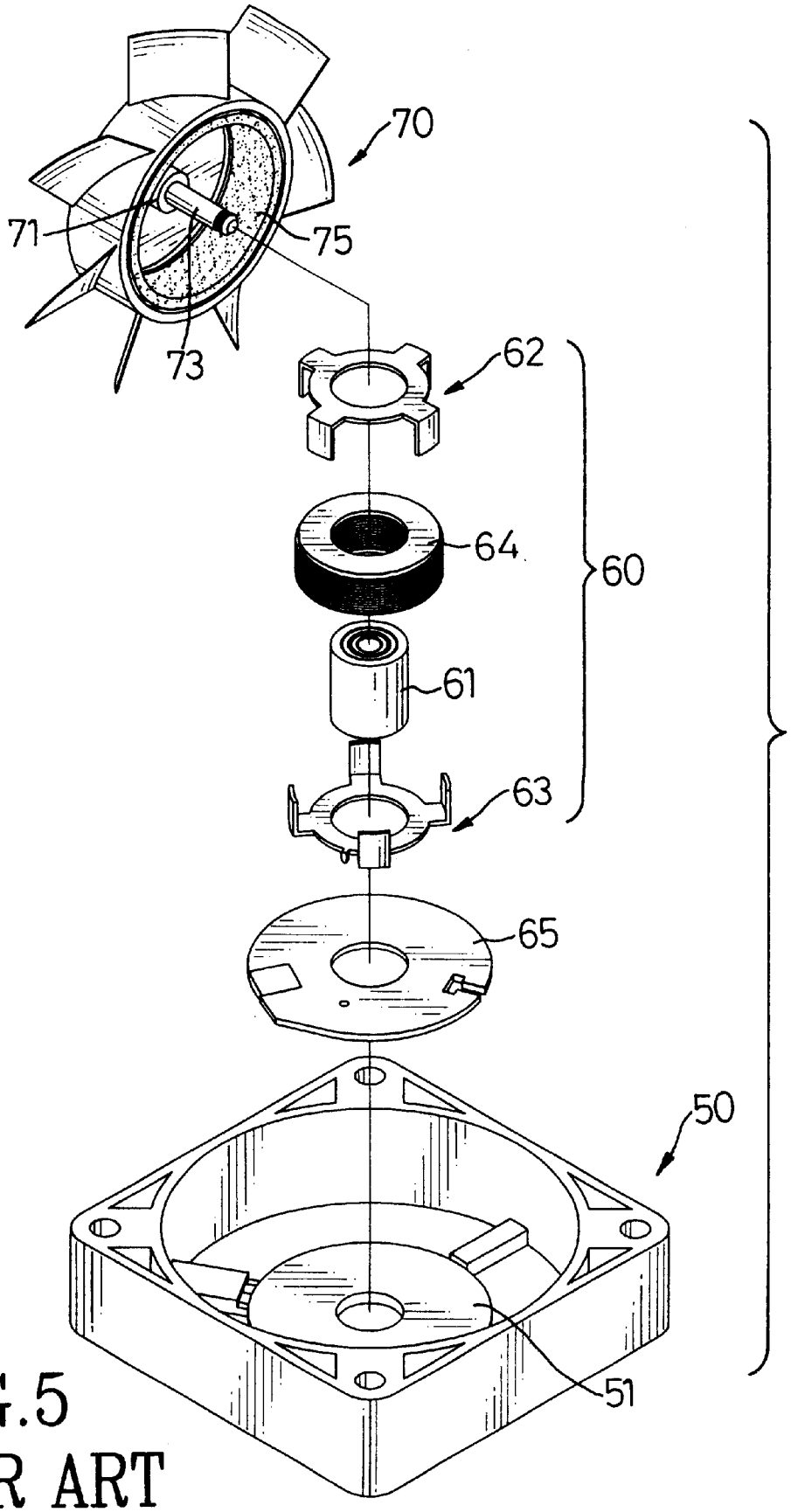
FIG.5 PRIOR ART
FIG. 5 is an exploded perspective view of a conventional cooling fan.
Figure 6:
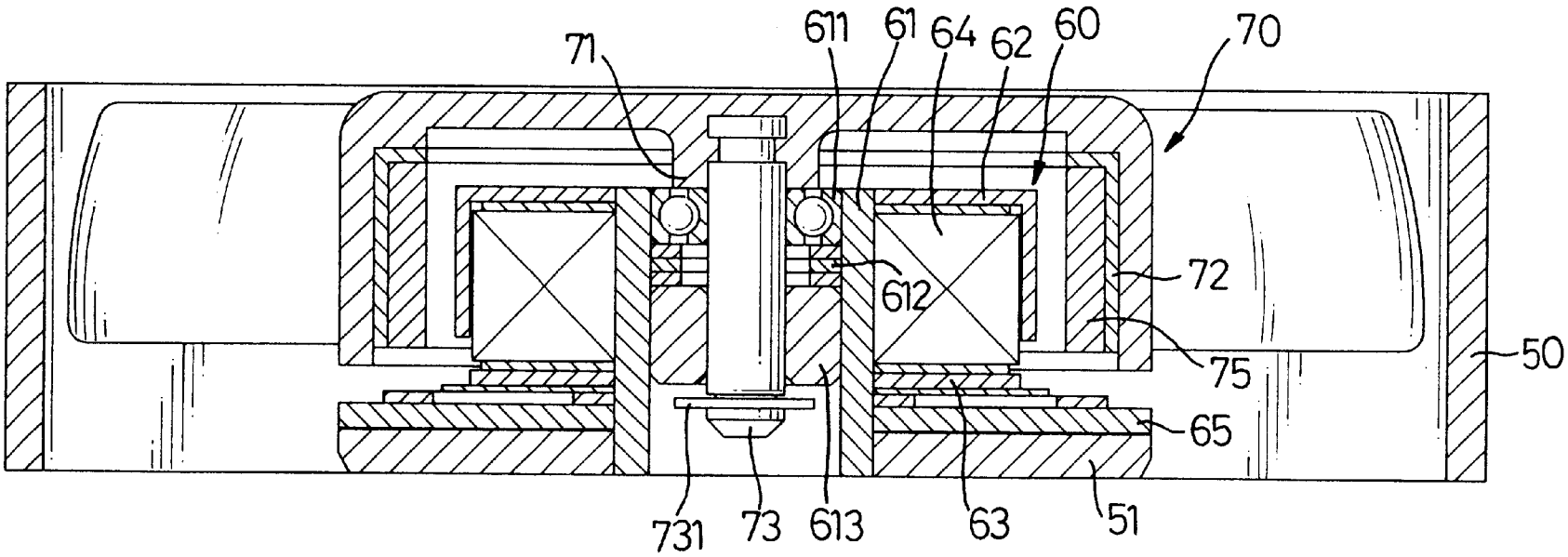
FIG. 6 PRIOR ART
FIG. 6 is a cross sectional side view of the cooling fan in FIG. 5.

With reference to FIG. 1, the magnetically assembled cooling fan in accordance with the present invention has a fan assembly (10), a stator assembly (20) and a housing (30) for securely receiving the fan assembly (10) and the stator assembly (20). Since the fan assembly (10) has the same basic structure as the conventional fan assembly (70) in FIG. 5, no additional detailed description is provided. However, the equivalent components are designated with different reference numerals, such as the seat is (11), the shaft is (13) and the annular permanent magnet is (15). The stator assembly (20) has a first conjugated plate (21), a second conjugated plate (23), a coil (22) securely received between the first and second conjugated plates (21, 23), an insulating plate (24) located under the second conjugated plate (23), a metal plate (25) located under the insulating plate (23) and a circuit board (26). The first and second conjugated plates (21, 23) and the coil (22) are designed to generate a magnetic field relative to that of the permanent magnet (15) of the fan assembly (10) so as to enable the fan assembly (10) to rotate continuously when the coil (22) is energized. The insulating plate (24) has a through hole (241) defined to allow a prong (231) formed on the second conjugated plate (23) to extend into the hole (241) and a central hole (242) defined to allow the insulating plate (24) to fit over the bearing housing (431). The metal plate (25) has a pair of opposed winged sections (251) integrally formed thereon. The winged sections (251) extends out from the outer periphery of the insulating plate (24), such that the winged sections (251) will be attracted by the permanent magnet (15). After the prong (231) on the second conjugated plate (23) is inserted into a positioning hole (261) in the circuit board (26), the metal plate (25) is thus secured between the insulating plate (24) and the circuit board (26)). Furthermore, a HALL sensor (262) to sense the polarity of the fan assembly (10) is mounted on the circuit board (26) at a location outside the area of the winged sections (251), such that the HALL sensor (262) will not be blocked by the winged sections (251) of the metal plate (25) and is able to sense the polarity of the permanent magnet (15) after assembly.

Figure 2:
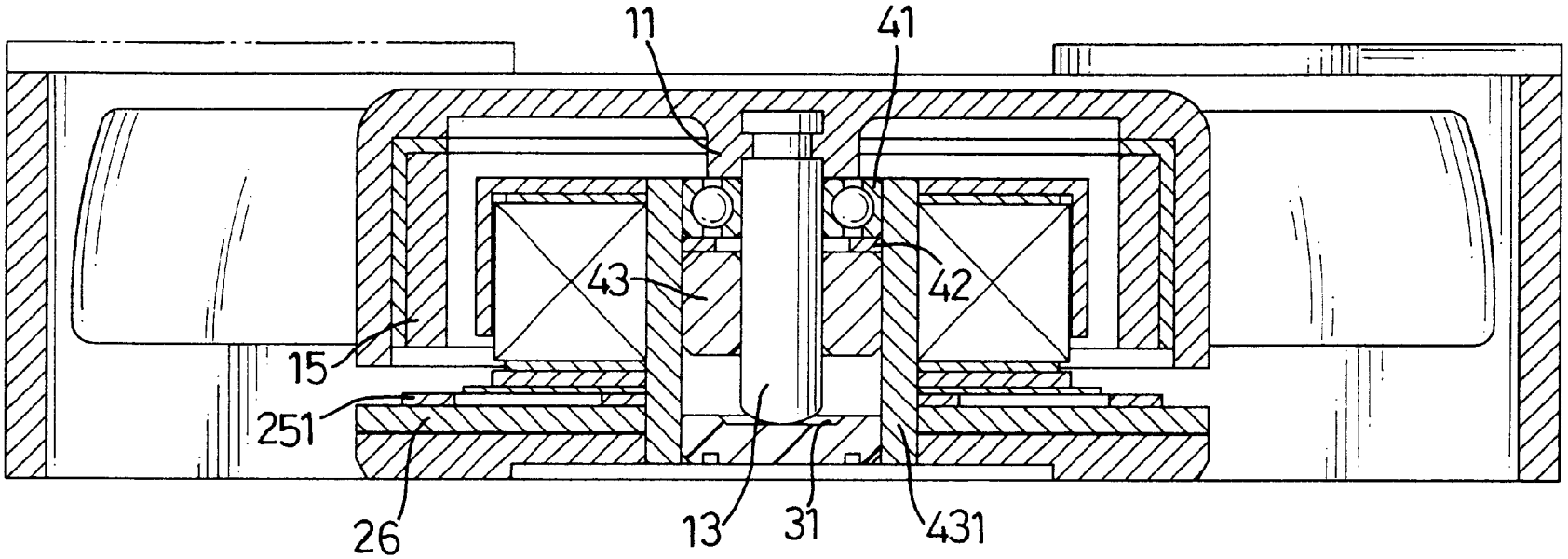
FIG. 2 is a cross sectional side view of the cooling fan in FIG. 1.

With reference to FIG. 2, it is noted that because the winged sections (251) of the metal plate (25) extend beyond the outer periphery of the insulating plate (24) with the outer edge,, of the winged sections (251) underneath the permanent magnet (15) of the fan assembly (10), the winged sections (251) pull the fan assembly (10) downward in relation to the housing (30), such that a fastener, such as a C-ring, is no longer necessary to hold the fan assembly (10) in position. By omitting the fastener on the shaft (13), the rotation of the shaft (13) is smooth and the shortcomings caused by the frictional resistance are overcome.

Referring to FIG. 1 and taking FIG. 2 for reference, beside the metal plate (25), the cooling fan has a lubricating assembly (40) pressed into a bearing housing (431) that is attached to the bottom face (32) of the housing (30). The lubricating assembly (40) has a ball bearing (41), a washer (42) and a self-lubricating bearing (43) each arranged after the other so as to allow the shaft (13) to extend therethrough. The seat (11) of the fan assembly (10) abuts the ball bearing (41) so as to ensure the smooth rotation of the shaft (13). Furthermore, to ensure the smooth rotation of the shaft (13), a thrust bearing (31) is pressed into the bottom of the bearing housing (431), such that the end of the shaft (13) abuts the thrust bearing (31).

Figure 3:
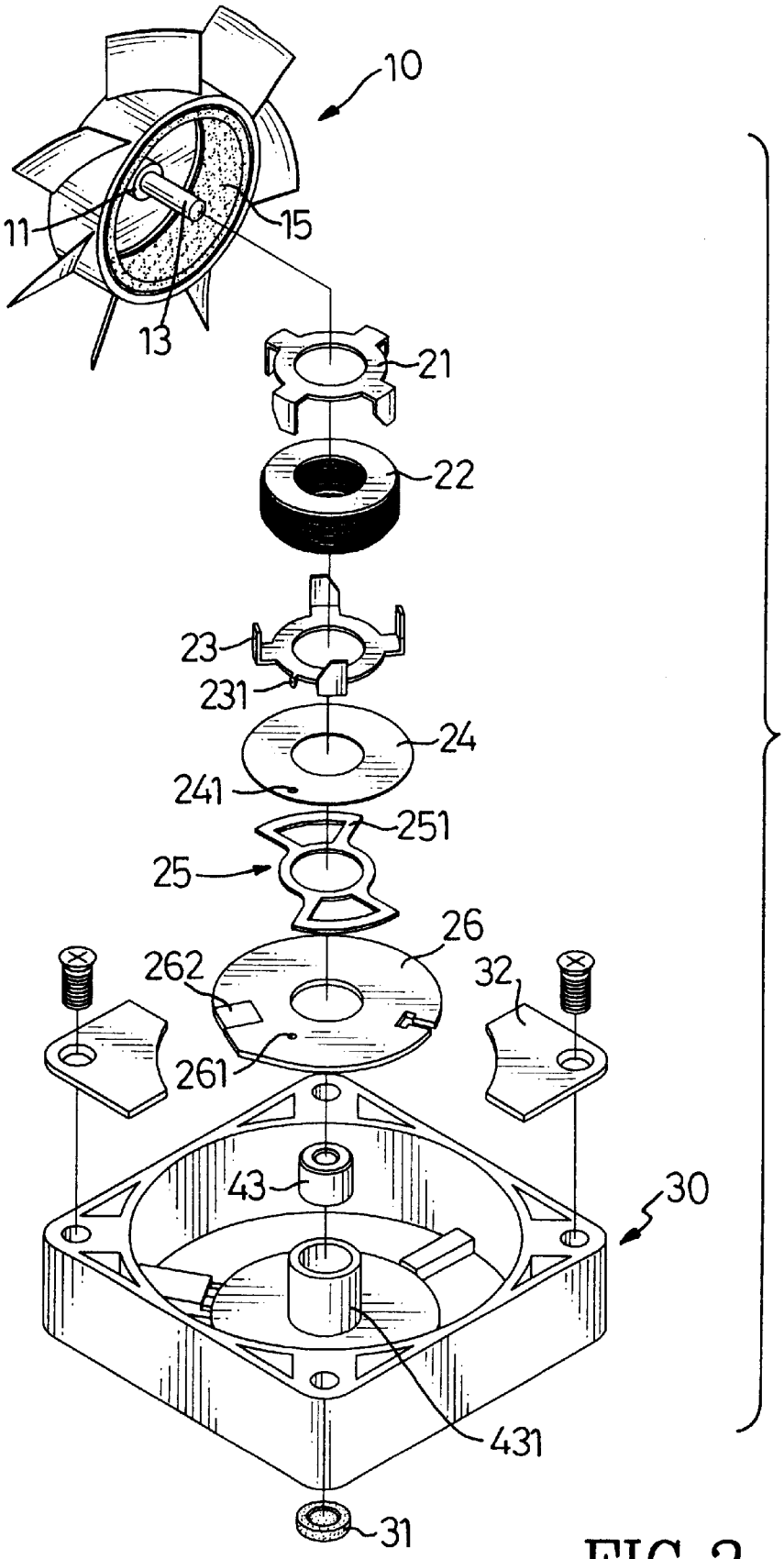
FIG. 3 is an exploded perspective view of the brushless cooling fan in accordance with the present invention with another type bearing.
Figure 4:
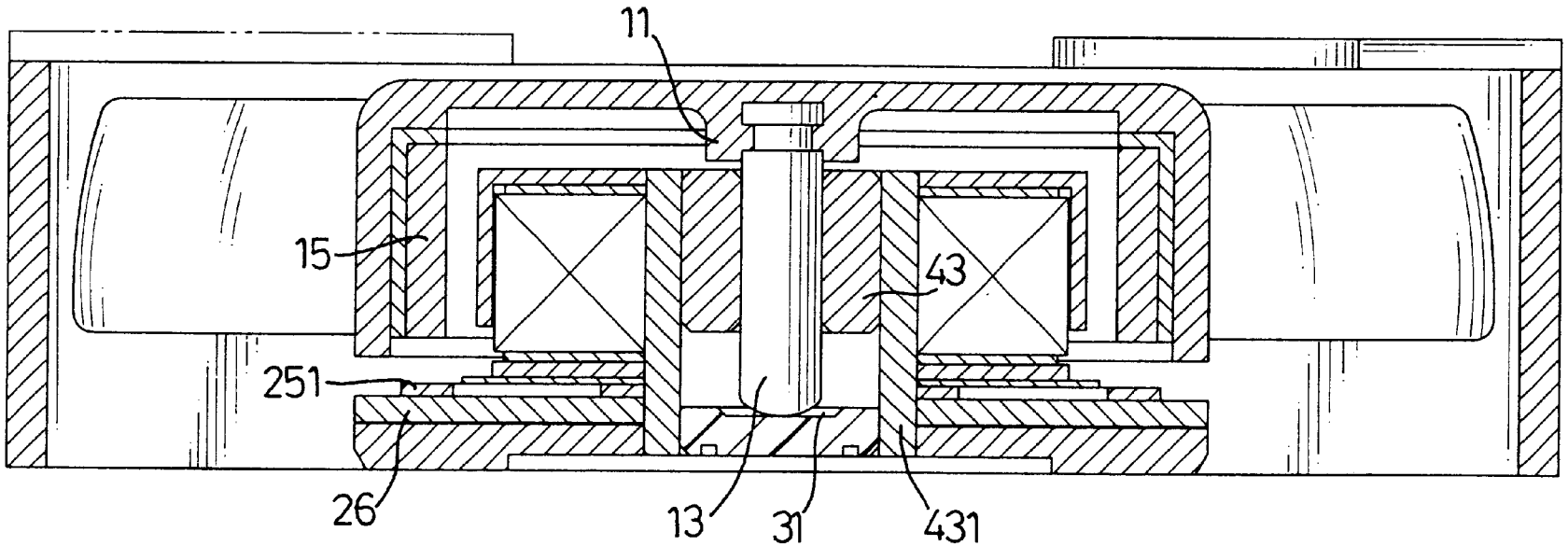
FIG. 4 is a cross sectional side view of the cooling fan in FIG. 3.

With reference to FIGS. 3 and 4, only the self-lubricating bearing (43) is provided to smooth the rotation of the shaft (13). Since the self-lubricating bearing (43) is self-aligning bearing, the seat (11) of the fan assembly (10) does not need to contact the self-lubricating bearing (43) to maintain its alignment. No matter what type of bearing is used in the cooling fan, the shaft (13) of the cooling fan is still able to work normally. Thus, the cost of manufacturing the cooling fan can be greatly reduced.

With reference to FIGS. 1 and 3, the cooling fan has two auxiliary retaining plates (32) mounted diagonally on comers the housing (30). With the two auxiliary retaining plates (32), the fan assembly (10) is held in position even if the fan assembly (10) is in an upside down position.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A magnetically assembled cooling fan comprising a fan assembly having a seat integrally formed on the inside of the fan assembly, a shaft extending out of the seat, an annular permanent magnet securely mounted within the fan assembly around the shaft, a stator assembly having a first conjugated plate, a second conjugated plate, a coil securely received between the first and the second conjugated plates, an insulating plate located under the second conjugated plate and a circuit board, means for rotating the fan assembly, a lubricating assembly engaged with the shaft to smooth the rotation of the shaft and a housing for receiving the fan assembly, the stator assembly, the rotation means and the lubricating assembly therein, wherein the improvement comprises:

a metal plate adapted to be situated between the circuit board and the insulating plate and having a pair of diagonally formed winged sections adapted to extend outwardly of the insulating plate so as to be attracted by the annular permanent magnet to pull the fan assembly downward in relation to the housing.

2. The magnetically assembled cooling fan as claimed in claim 1, comprising a thrust bearing received by the bearing housing to abut the free end of the shaft.

3. The magnetically assembled cooling fan as claimed in claim 1, wherein a pair of auxiliary retaining plates are provided to hold the fan assembly in the housing.

4. A magnetically assembled cooling fan comprising a fan assembly having a seat integrally formed on the inside of the fan assembly, a shaft extending out of the seat, an annular permanent magnet securely mounted within the fan assembly around the shaft, a stator assembly having a first conjugated plate, a second conjugated plate, a coil securely received between the first and the second conjugated plates, an insulating plate located under the second conjugated plate and a circuit board, means for rotating the fan assembly, a lubricating assembly engaged with the shaft to smooth the rotation of the shaft and a housing for receiving the fan assembly, the stator assembly, the rotation means and the lubricating assembly therein, wherein the improvements comprise:

a metal plate adapted to be situated between the circuit board and the insulating plate and having a pair of diagonally formed winged sections adapted to extend outwardly of the insulating plate so as to be attracted by the annular permanent magnet to pull the fan assembly downward in relation to the housing; and a pair of auxiliary retaining plates being provided to hold the fan assembly in the housing.

* * * * *